US006168480B1

(12) United States Patent
Schaller

(10) Patent No.: US 6,168,480 B1
(45) Date of Patent: Jan. 2, 2001

(54) PUSH POLE FOR A BOAT

(76) Inventor: Robert J. Schaller, 3285 Westwood Dr., Titusville, FL (US) 32796

( * ) Notice: Under 35 U.S.C. 154(b), the term of this patent shall be extended for 0 days.

(21) Appl. No.: 09/227,622

(22) Filed: Jan. 8, 1999

(51) Int. Cl.[7] ..... B63H 19/00
(52) U.S. Cl. ..... 440/36; 114/221 R
(58) Field of Search ..... 440/36, 21, 101, 440/102; 114/221 R; 37/345, 346

(56) References Cited

U.S. PATENT DOCUMENTS

| | | | | |
|---|---|---|---|---|
| 103,007 | | 5/1870 | Bibber . | |
| 179,127 | | 6/1876 | Norcross . | |
| 373,194 | | 11/1887 | Reed . | |
| 806,019 | * | 11/1905 | Sullivan et al. | 114/221 R |
| 1,164,361 | | 12/1915 | Kilgore . | |
| 1,383,559 | * | 7/1921 | Olsen | 440/36 |
| 1,573,539 | | 2/1926 | Brown . | |
| 2,477,410 | | 7/1949 | Johnson . | |
| 2,787,795 | * | 4/1957 | Snodgrass | 416/71 |
| 2,939,418 | * | 6/1960 | Johnson | 114/101 |
| 3,043,261 | | 7/1962 | Snodgrass . | |
| 3,048,139 | | 8/1962 | Duckett . | |
| 3,105,715 | | 10/1963 | Happ . | |
| 3,799,099 | * | 3/1974 | Conover | 114/221 R |
| 4,037,554 | * | 7/1977 | Foscolo | 114/221 R |
| 4,121,531 | * | 10/1978 | Norton | 114/221 R |

* cited by examiner

*Primary Examiner*—S. Joseph Morano
*Assistant Examiner*—Andrew D. Wright
(74) *Attorney, Agent, or Firm*—Holland & Knight LLP; Robert L. Wolter; Terry M. Sanks

(57) ABSTRACT

A push pole for propelling a boat comprising an elongated straight pole having a first and second end and a foot extending from the second end of the elongated pole. The foot consists of two prongs where the first prong extends coaxially in relation to the elongated pole and the second prong has an arcuate shape disposed towards the first prong. The first prongs has a spiraled configuration between a spade-like terminus and the elongated pole. The second prong has a spade-like terminus. The configuration of the foot provides for efficient insertion and release of the prongs from the floor of a waterway.

12 Claims, 2 Drawing Sheets

PUSH POLE FOR A BOAT

FIELD OF THE INVENTION

This invention relates generally to boating accessories, and more specifically relates to push poles used to manually propel boats.

BACKGROUND OF THE INVENTION

Owners of small, shallow hulled boats often use their boats for traveling through shallow waterways. When afloat, a boat owner may wish to move his boat without causing a significant disturbance around the boat which could disturb marine life in the immediate area surrounding the boat. A push pole is preferred because propelling boats with oars or propellers would cause too much of a disturbance. When poling a boat through shallow waters, the soft mud on the floor can yield and the push pole can become lodged within the floor. If the push pole sinks deep enough within the mud a boat operator may not be able dislodge the push pole from the waterway floor. The key to effective poling is having a push pole with a foot capable of releasing from the floor of a body of water. Depending upon the softness of the mud and the design of a pole's foot, poling a boat without an adequate pole is difficult.

Generally, a push pole includes an elongated straight pole and a foot mounted on one end of the pole. The foot may include two prongs disposed in an inverted V-shape, or a generally planar triangular member. Though effective, many of the prior art push poles are expensive. Towards this end, boat owners who desire to use push poles would benefit from a less expensive, but durable push pole which floats if dropped in the water and, is capable of effectively releasing from the muddy floor of a body of water.

SUMMARY OF THE INVENTION

The object of the present invention is to provide an inexpensive yet durable push pole capable of propelling a boat and then being easily released by the boat's occupant from the muddy floor of a body of water. The push pole generally includes an elongated straight pole member having a first end toward which a user may grasp the push pole and a second end distal the first end. A foot is mounted to the second end of the elongated pole member. The foot consists of two prongs where a first prong extends coaxially in relation to the elongated pole member. A second prong is mounted to the second end of the elongated pole member and has a generally arcuate shape. Each of the first and second prongs has a spade-like terminus for insertion in the floor of a waterway. The first prong has a spiraled configuration between the spade-like terminus and the elongated pole member for an efficient release from the floor of the waterway.

DETAILED DESCRIPTION OF THE INVENTION

Figure 1:
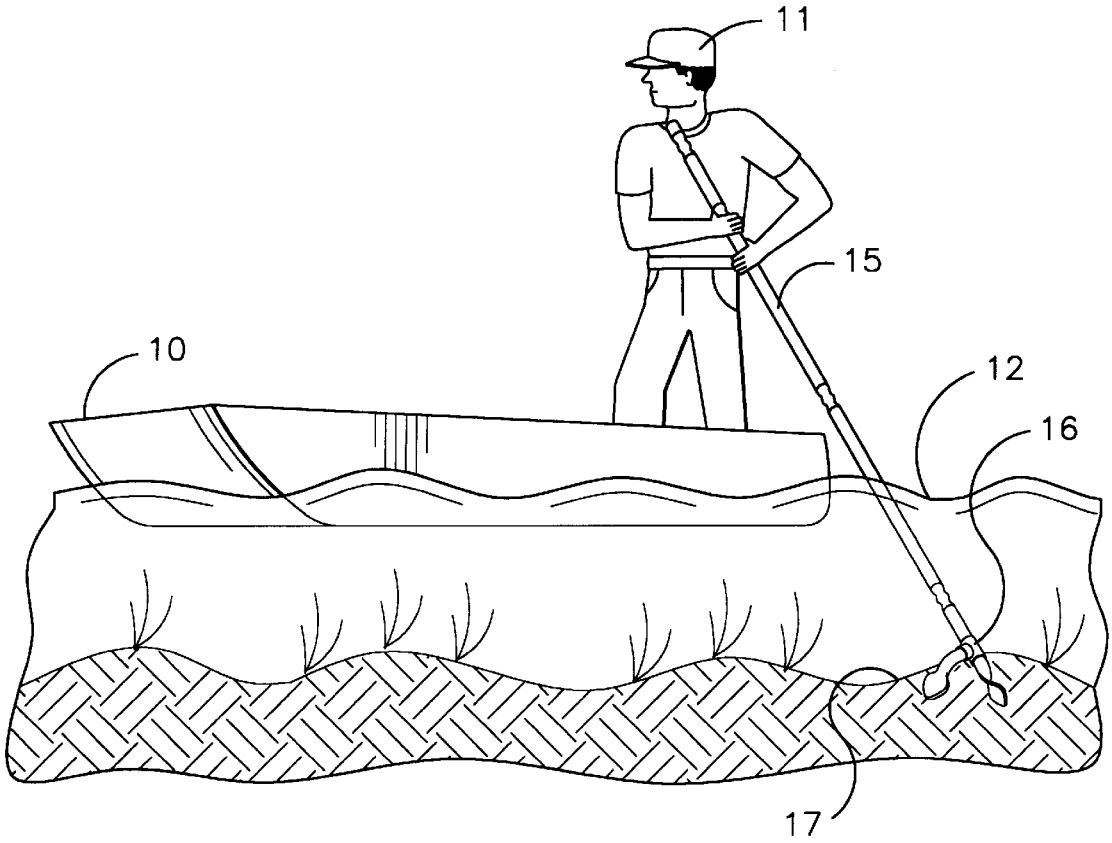
FIG. 1 illustrates a push pole in use.

FIG. 1 illustrates a push pole in use. In the embodiment of FIG. 1 a boat 10 and its occupant 11 are afloat upon a body of water 12. The occupant grasps a push pole 15. The occupant 11 is using the push pole 15 to propel the boat 10. The push pole's foot 16 is embedded in the floor 17 of the body of water 12.

Figure 2:
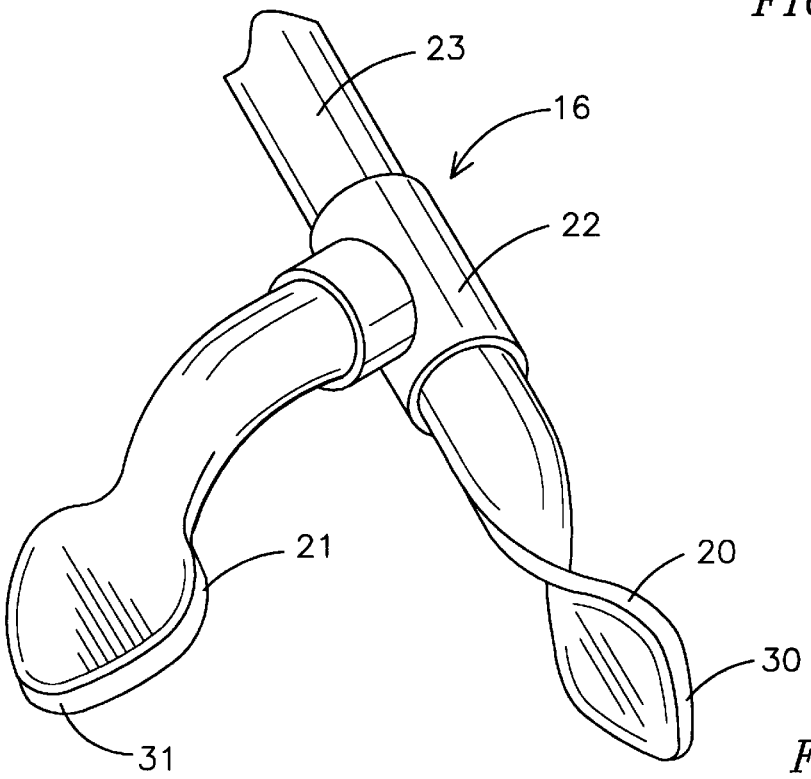
FIG. 2 illustrates a perspective view of the two prongs of the push pole's foot.
Figures 3, 4:
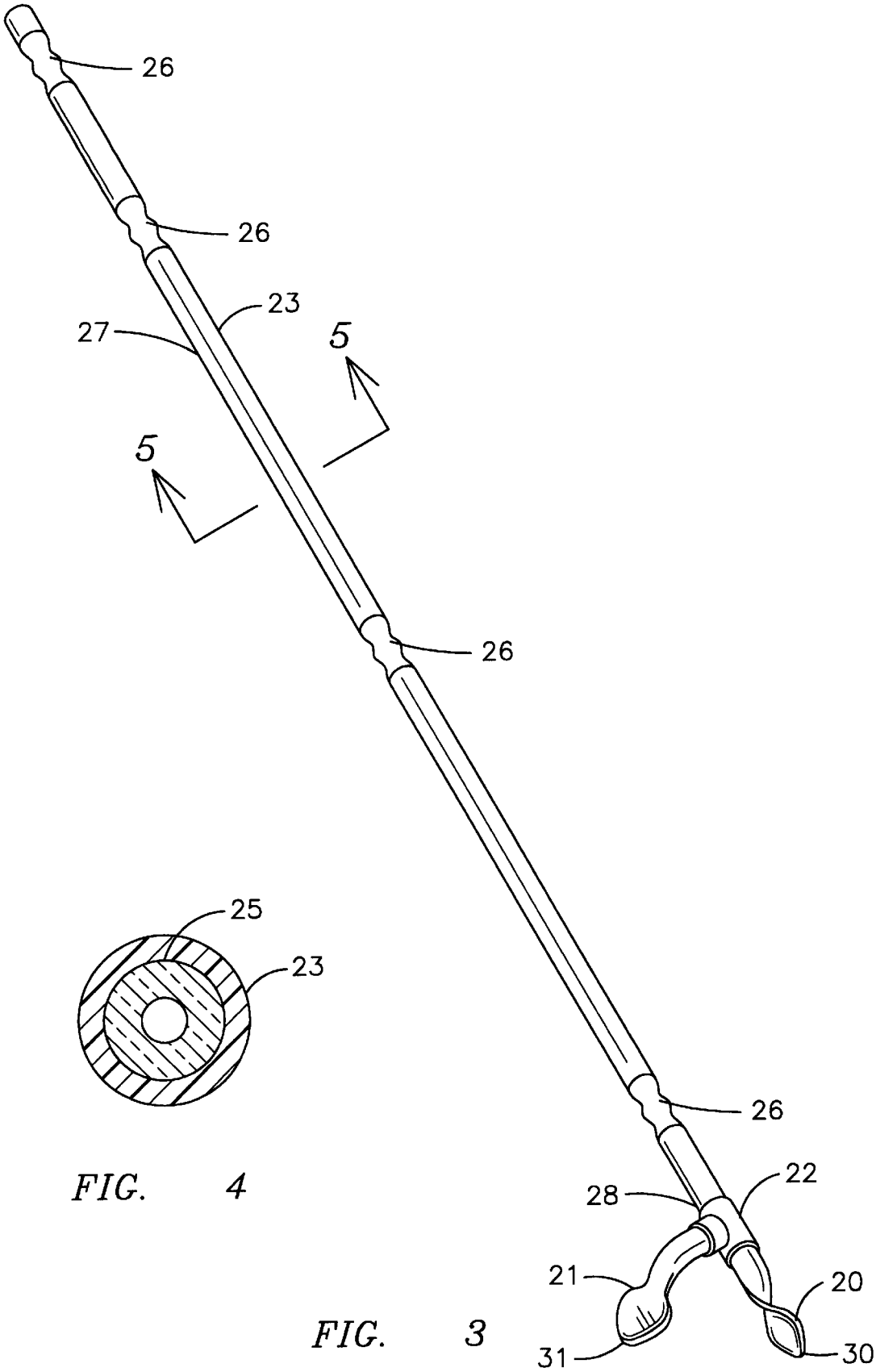
FIG. 3 illustrates a perspective view of all of the push pole.
FIG. 4 is a cross sectional view of the elongated pole member of the push pole taken along section 5—5.

With respect to FIGS. 2 and 3, the different elements of the push pole are illustrated including an elongated pole member 23 and a foot 16. The elongated pole member 23 is substantially straight and has a first end 27 toward which the occupant grasps the push pole 15 and a second end 28 to which the foot 16 is mounted. The elongated pole member 23 is substantially straight in order to control the direction of travel of the boat when propelled by its occupant 11.

In the embodiment shown in FIG. 2, the push pole's foot 16 consists of a first prong 20 and second prong 21 and a means for connecting the first prong 20 and second prong 21 of the push pole's foot 16 to the push pole's elongated pole member 23. In the present invention, the means for connecting the prongs 20, 21 and elongated pole member 23 is a joint 22. The joint 22, made of strengthened PVC, has a first opening to connect to the elongated pole member 23, a second opening to connect to the first prong 20 and a third opening to connect to the second prong 21. The first prong 20 is coaxially aligned with the elongated pole member 23 of the push pole 15 with a spiral configuration disposed between a spade-like terminus 30 and the elongated pole 23. The second prong, with its spade-like terminus 31, has an arcuate shape disposed towards the first prong 20.

FIGS. 3 and 4 illustrate a preferred embodiment of the push pole 15. In the present embodiment the outer components of the push pole 15 are made of strengthened PVC. The elongated pole member 23 is a tubular member. As shown in FIG. 4, an insert 25 fits within the elongated pole member 23. The elongated pole member 23 is crimped 26 at specific locations to firmly secure the insert 25 inside of the tubular member. In the present invention, the embodiment of the insert 25 is made of a fiberglass reinforced synthetic resin tube called EXTREN, U.S. Trademark No. 1,543,552. Depending upon the material selected, either a lightweight, but sturdy tube or rod could be used to strengthen the elongated pole member 23.

FIG. 4 is a cross sectional view of the elongated pole member 23 of the push pole 15 taken along section 5—5. The insert 25 is included to provide additional stiffness to the elongated pole member 23.

While the invention has been described in what is presently considered to be a preferred embodiment, many variations and modifications will become apparent to those skilled in the art. Accordingly, the invention should not be limited to the specific illustrative embodiment but be interpreted within the full spirit and scope of the appended claims.

What is claimed is:

1. A push marine pole for propelling a boat comprising:

(a) an elongated pole member having a first end toward which a user may grasp the push pole for use, and a second end distal said first end;

(b) a first prong with a first end mounted to the second end of said elongated pole member and extending coaxially with said elongated pole member to a second end; and (c) a second prong with a first end mounted to the second end of the elongated pole member having a generally arcuate shape where a second end is disposed toward said second end of said first prong.

2. The push pole as defined in claim 1 wherein said first prong contours in a spiral configuration disposed between the second end having a spade-like terminus and said elongated pole member.

3. The push pole as defined in claim 2 wherein said second prong has a spade-like terminus at said second end.

4. The push pole as defined in claim 1 wherein said elongated pole member is tubular having an insert extending from said first end of said elongated pole member to said second end, fixed within said elongated pole member.

5. The push pole as defined in claim 4 wherein said elongated pole member is crimped at distinct locations to secure said insert within said elongated pole member.

6. A push marine pole for propelling a boat comprising:

(a) a tubular elongated pole member having a first end toward which a user may grasp the push pole for use, and a second end distal said first end;

(b) an elongated insert extending from said first end of said pole member to said second end of said pole member, secured within said tubular elongated pole member; and (c) means mounted to said second end of the elongated pole member for connecting a first prong and a second prong to said tubular elongated pole member where said first prong with a first end mounted to said second end of said pole member, extends coaxially with said elongated pole member and terminates at a second end and said second prong has a generally arcuate shape where a second end is disposed toward said second end of said first prong.

7. The push pole as defined in claim 6 wherein said first prong contours in a spiral configuration disposed between a spade-like terminus and said elongated pole member.

8. The push pole as defined in claim 6 wherein said second prong has a spade-like terminus.

9. The push pole as defined in claim 6 wherein said tubular elongated pole member is crimped at distinct locations to secure said insert within said elongated pole member.

10. A push marine pole foot mounted on one end of an elongated pole member used to manually propel a boat, said foot comprising:

(a) a first prong, with a first end connected to said elongated pole member, extending coaxially with said elongated pole member to a second end; and (b) a second prong, with a first end connected to said elongated pole member, having a generally arcuate shape with a second end disposed toward said second end of said first prong.

11. The push pole foot as defined in claim 10 wherein said first prong contours in a spiral configuration disposed between a spade-like terminus and said elongated pole member.

12. The push pole foot as defined in claim 10 wherein said second prong has a spade-like terminus.

* * * * *